US009743742B2

(12) United States Patent
Brogoitti et al.

(10) Patent No.: US 9,743,742 B2
(45) Date of Patent: Aug. 29, 2017

(54) PORTABLE INTERCHANGEABLE COSMETIC COMPACT

(71) Applicants: Clairesse Brogoitti, Santa Monica, CA (US); Marc Brogoitti, Santa Maria, CA (US); Megan Langdon, Santa Monica, CA (US); Arnando Villarreal, Santa Monica, CA (US)

(72) Inventors: Clairesse Brogoitti, Santa Monica, CA (US); Marc Brogoitti, Santa Maria, CA (US); Megan Langdon, Santa Monica, CA (US); Arnando Villarreal, Santa Monica, CA (US)

( * ) Notice: Subject to any disclaimer, the term of this patent is extended or adjusted under 35 U.S.C. 154(b) by 144 days.

(21) Appl. No.: 14/599,477

(22) Filed: Jan. 17, 2015

(65) Prior Publication Data

US 2015/0201733 A1 Jul. 23, 2015

Related U.S. Application Data

(60) Provisional application No. 61/929,038, filed on Jan. 18, 2014.

(51) Int. Cl.

| | |
|---|---|
| ***A45D 33/28*** | (2006.01) |
| ***A45D 33/32*** | (2006.01) |
| ***A45D 33/20*** | (2006.01) |
| ***A45D 33/22*** | (2006.01) |
| ***A45D 33/00*** | (2006.01) |
| ***A45D 33/26*** | (2006.01) |
| ***A45D 34/06*** | (2006.01) |
| ***A45D 40/18*** | (2006.01) |

(Continued)

(52) U.S. Cl.

CPC ..... *A45D 33/28* (2013.01); *A45D 33/008* (2013.01); *A45D 33/20* (2013.01); *A45D 33/22* (2013.01); *A45D 33/26* (2013.01); *A45D 33/32* (2013.01); *A45D 34/06* (2013.01); *A45D 40/18* (2013.01); *A45D 40/22* (2013.01); *A45D 40/24* (2013.01)

(58) Field of Classification Search

CPC ..... A45D 33/28; A45D 33/26; A45D 33/24; A45D 33/20; A45D 40/0087; A45D 40/006; A45D 40/22; A45C 11/008; A45C 13/02; A45C 3/00

See application file for complete search history.

(56) References Cited

U.S. PATENT DOCUMENTS 823,778 A * 6/1906 Herbeck ..... B65D 5/5266 190/16

1,735,183 A * 11/1929 Salerno ..... A45C 5/005 132/315

(Continued)

*Primary Examiner* — Robyn Doan

(57) ABSTRACT

The present invention is a portable, interchangeable cosmetic compact. The compact is capable of housing a plurality of customizable cosmetics for all-in-one convenience, portability, and efficiency. The present invention is designed as a portable makeup compact in which the user can store multiple makeup products and makeup tools in one unit. The purpose of this makeup compact is to be small and portable as well as hosting different makeup products and makeup tools that form one unit when stored within the base unit and lids of the compact. The portable interchangeable cosmetic compact allows individual makeup products and makeup tools to be interchanged and stored within the base unit and lids because of this makeup compact's unique design and efficient utilization of space.

21 Claims, 11 Drawing Sheets

(51) Int. Cl.
*A45D 40/22* (2006.01)
*A45D 40/24* (2006.01)

(56) References Cited

U.S. PATENT DOCUMENTS

| | | | | | |
|---|---|---|---|---|---|
| 1,866,162 | A * | 7/1932 | Hall | A45D 33/26 | 132/294 |
| 3,132,652 | A * | 5/1964 | Gazdik | A45D 33/28 | 132/297 |
| 3,317,078 | A * | 5/1967 | Gordon | E05D 1/04 | 16/293 |
| 4,744,376 | A * | 5/1988 | Verducci | A45C 11/24 | 132/297 |
| 4,944,402 | A * | 7/1990 | Wu | A45D 33/20 | 132/287 |
| 5,005,697 | A | 4/1991 | Jimbo | | |
| 5,337,890 | A * | 8/1994 | Lai | A45D 40/22 | 132/296 |
| 5,513,754 | A | 5/1996 | Chang | | |
| 5,520,202 | A | 5/1996 | Arbree | | |
| 5,579,940 | A * | 12/1996 | Weiss | A45C 11/008 | 132/287 |
| 5,655,553 | A | 8/1997 | Giese et al. | | |
| 6,412,640 | B1 | 7/2002 | Destanque et al. | | |
| 6,532,970 | B2 | 3/2003 | Phue | | |
| 6,796,431 | B1 | 9/2004 | Golldring | | |
| 6,932,220 | B2 | 8/2005 | Byun | | |
| 6,986,355 | B2 | 1/2006 | Byun | | |
| 7,021,318 | B2 | 4/2006 | Byun | | |
| 7,140,372 | B2 | 11/2006 | Byun | | |
| 7,591,382 | B2 | 9/2009 | Brock | | |
| 7,740,370 | B2 | 6/2010 | Campbell et al. | | |
| 7,866,328 | B2 | 1/2011 | Chen | | |
| 7,975,706 | B2 | 7/2011 | Chen | | |
| 8,322,354 | B2 * | 12/2012 | Parker | A45D 33/20 | 132/287 |
| 8,770,209 | B2 | 7/2014 | Kim et al. | | |
| 2006/0226164 | A1 * | 10/2006 | Graham | A45D 33/24 | 220/840 |
| 2008/0302383 | A1 | 12/2008 | de Montjamont | | |
| 2009/0323319 | A1 * | 12/2009 | Lin | A45D 33/008 | 362/144 |
| 2014/0318570 | A1 | 10/2014 | Petry | | |

* cited by examiner

PORTABLE INTERCHANGEABLE COSMETIC COMPACT

This invention claims benefit and priority to U.S. Provisional Application No. 61/929,038 filed Jan. 18, 2014 under 35 U.S.C. 119. All references from that application are incorporated herein.

FIELD OF INVENTION

The present invention relates generally to a portable, interchangeable cosmetic compact. The compact is capable of housing a plurality of customizable cosmetics for all-in-one convenience, portability, and efficiency.

BACKGROUND

This invention relates to cosmetic compacts that are built to store makeup and cosmetic products. Traditional makeup compacts are designed to host minimal amounts of cosmetic products, which can not be replenished once the product has been depleted by the user. The design of traditional cosmetic compacts creates various problems for users, for example:

(1) Traditional compacts are not designed to be re-usable;
(2) Traditional compacts are not designed to be customizable;
(3) Traditional compacts are not designed to host multiple cosmetic products; and
(4) Traditional compacts are bulky, which creates problems with the portability of cosmetic products.

Previous attempts to solve the problems of the traditional makeup compact such as those produced by Victoria Jackson provide an all-in-one product that cannot be customized and is bulky and difficult to use. Other manufacturers, such as Mary Kay and Shu Uemera have provided customizable makeup, but not in an all-in-one, user-friendly product. Still, other brands like Ellis Faas has created a tube system that contains makeup products in the form of pencil like tubes, but again, the system is messy, difficult to use, and only a limited amount of makeup products can fit within the tube system. Women want a customizable compact that can hold a complete set of makeup products, contain makeup suiting each woman's unique complexion, is portable and is cost efficient.

There is a need for an all-in-one makeup compact that is lightweight, high quality, user friendly, customizable, and cost-efficient. The present invention fills this need.

BRIEF SUMMARY

This is a portable makeup compact containing customizable makeup products and tools that is both efficient and lightweight.

Additional features and advantages of the portable interchangeable cosmetic compact will be set forth in the description which follows, and in part will be apparent from the description, or may be learned by practice of and use of the portable interchangeable cosmetic compact. The objectives and other advantages of the portable interchangeable cosmetic compact will be realized and attained by the structural properties particularly pointed out in the written description and claims, as well as the appended drawings.

The present invention is designed as a portable makeup compact in which the user can store multiple makeup products and makeup tools in one unit. The purpose of this makeup compact is to be small and portable as well as hosting different makeup products and makeup tools that form one unit when stored within the base unit and lids of the compact. The portable interchangeable cosmetic compact allows individual makeup products and makeup tools to be interchanged and stored within the base unit and lids because of this makeup compact's unique design and efficient utilization of space.

In the preferred embodiment, the portable interchangeable compact is a rectangular shape, but as is apparent, it can also be built in different shapes such as a cube or cylindrical design. The base unit and lids of the cosmetics compact are designed to allow different products to be inserted and become part of the overall unit.

The portable interchangeable cosmetic compact has two exterior walls of the base unit and lids, which are built with two cylindrical hollow spaces each, which allow cylindrical tubes to be inserted and become part of the overall base unit. These cylindrical tubes can be designed with caps to access the substance stored inside the tube. These hollow openings are designed to host cylindrical tools or tubes that fit the specific dimensions. The cylindrical tubes can host a variety of cosmetic products, including, but not limited to, mascara, lipgloss, lipstick, liquid eyeshadow, eyeliner, concealer, foundation, primer, skincare, perfume, nail polishes and varnishes, or cosmetic tools such as makeup brushes, sponges etc.

The cylindrical spaces have a track system, which allows the tubes to be docked and secured within the body of the base unit and lids. They are secured until the user chooses to remove them. The track is designed to allow the tube to be partially ejected from the base unit and lock in place so that the user can remove the cap of the tube to use the cosmetic product or applicator tool. The track only allows the tube base to translate, and not rotate, securing the base from rotating as the cap is unscrewed. Once the user is finished using the tube, they can re-insert the tube into the base unit for it to be stored. Notably, the four hollow cylindrical spaces in the base unit can also be shaped differently, including, but not limited to, rectangular design. Wherein the spaces are of an alternate shape, the tubes will be of a like shape to fit the space (i.e. if rectangular, the tubes or tools would be rectangular). The track mechanism can also be designed for the caps of the tubes to be removed differently from the base unit.

The two remaining exterior walls of the portable interchangeable cosmetic compact are lids, with integral mirrors that may include illumination, designed to allow the user to access the interior of the base unit. One side of the base unit is comprised of a hinge, upon which the mirrored lid pivots. This feature is duplicated on the opposite side of the base unit and is oriented on the diagonal corner, but not limited in this orientation.

Opposite the hinges, on the base unit, is comprised of clasps, which secures the mirrored lids in the closed position. These clasps may be magnetic.

The base unit has two recesses, one on either side, which allows a tray to fit within each recess. This functionality is designed to host trays of cosmetic products including, but not limited to, eyeshadow, blush, powder, lipstick, bronzer, concealer, foundation skincare and applicator tools such as makeup brushes, puffs, and sponges as well as personal grooming tools such as tweezers, combs, manicure sets, pencil sharpeners, and personal items such as jewelry and the tray function allows the cosmetic products to nest in the base unit. The cosmetic products contained in the tube or tray that fits within the base unit and lids can be various substances including, but not limited to, powder, gel, liquid, paste, or solid. The recesses are designed to have a tray function in which the user can remove and replace the tray to allow products or tools hosted in the tray to be interchanged. Once the tray is inserted into the recess of the base unit, it locks in place and secures all of cosmetic products and/or tools in the base unit of the compact. The cosmetic products are hosted in square and/or rectangle pans, which are built to the same specifications of the tray and recess. The products and/or tools can also be loose and stored within the recess of the base unit. When the clasps are closed, all products and/or tools can be safely stored within the base unit. The recesses can also be designed to hold products with magnetic technology.

Additionally, the user can choose not to store cosmetic products within the recess on either side of the base unit and instead use the space to store small objects that they find useful, such as tweezers, q-tips, bobby pins, brushes, personal items such as jewelry etc.

The advantage of this cosmetic compact design is that the small space is strategically used to allow different makeup products, makeup tools, personal items, as well as personal grooming tools to fit securely in one base unit that is portable and interchangeable. Another advantage of this makeup compact is that once one makeup product has been finished, it can be replaced without the necessity of discarding and replacing the entire base unit or compact. The predominant designs of products of this sort do not have replacement products, but are designed for the entire unit to be replaced.

It is to be understood that both the foregoing general description and the following detailed description are exemplary and explanatory only and are not restrictive of the portable interchangeable cosmetic compact, as claimed.

The accompanying drawings, which are incorporated in and constitute part of this specification, illustrate embodiments of the invention and together with the description, serve to explain the principles of the invention.

DRAWINGS

DETAILED DESCRIPTION

Figure 1:
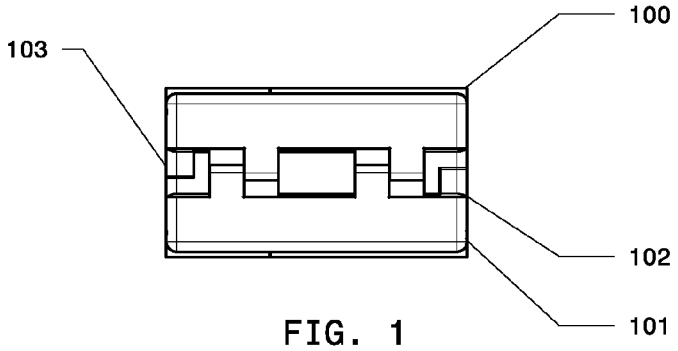
FIG. 1 is a rear view of the base unit, as in one embodiment of the portable cosmetic compact.

Reference will now be made in detail to the present preferred embodiments of the portable interchangeable cosmetic compact, examples of which are illustrated in the accompanying drawings. Wherever possible, the same reference characters will be used throughout the drawings to refer to the same or like parts.

FIG. 1 is a rear view of the compact where an upper 100 and lower 101 lid are shown in the closed position. This view shows the rear hinge 102 component which functions to secure the base unit 103 and upper 100 and lower 101 lids one compact product. As in the preferred embodiment, two hinges 102 are used to secure the base unit 103 to the upper 101 and lower 102 lids of the compact. The size of the compact may vary, as is known by those in the art. In one preferred embodiment, the length of the compact is approximately 3.43 inches, and the height is approximately 1.93 inches. As is known by those in the art the upper 100 and lower 101 lids and base unit 103 may be comprised of variety of natural and synthetic materials including, but not limited to, plastic, metal, and or/wood. In one preferred embodiment the upper 100 and lower 101 lids and base unit 103 are comprised of a lightweight, shock-resistant plastic. It is understood that the upper 100 and lower 101 lids and base unit 103 may be manufactured in a variety of colors and finishes including metallic, mattes, patterns and natural shades.

Figure 2:
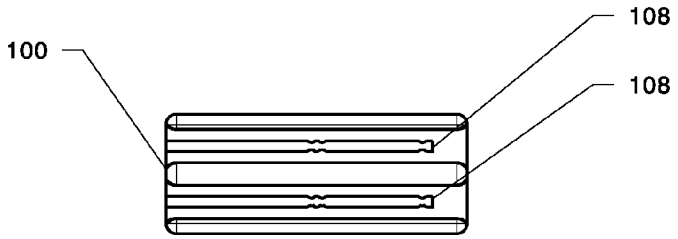
FIG. 2 is a top view of the track system in the upper lid, as in one embodiment of the portable interchangeable cosmetic compact.

FIG. 2 is a view of the track system 108 within the upper lid 100 of the portable interchangeable cosmetic compact. The track system allows for the tubes 104 and 105 (discussed below) to be secured within the upper lid 100.

Figure 3:
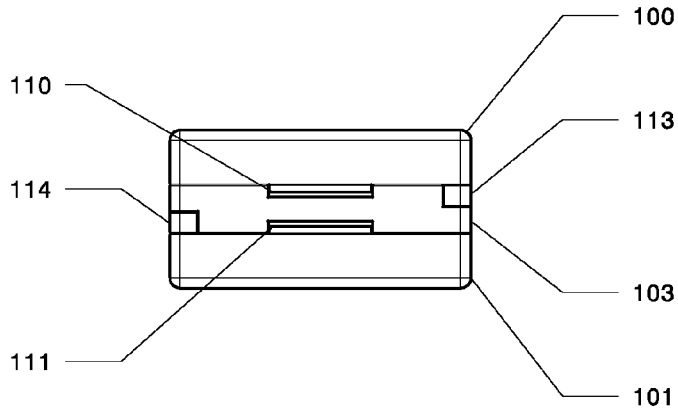
FIG. 3 is a front view of the base unit of the portable interchangeable cosmetic compact, as in one embodiment.

FIG. 3 is a front view of the medial base unit 103 between the upper 100 and lower 101 lids. The upper 100 and lower 101 lids are closed with an upper clasp 110 and lower clasp 111 which secures the upper 100 and lower 101 lids to the base unit 103. The upper 110 and lower 111 clasp may use any interlocking mechanism or magnetic mechanism as is known well by those skilled in the art.

Figure 4:
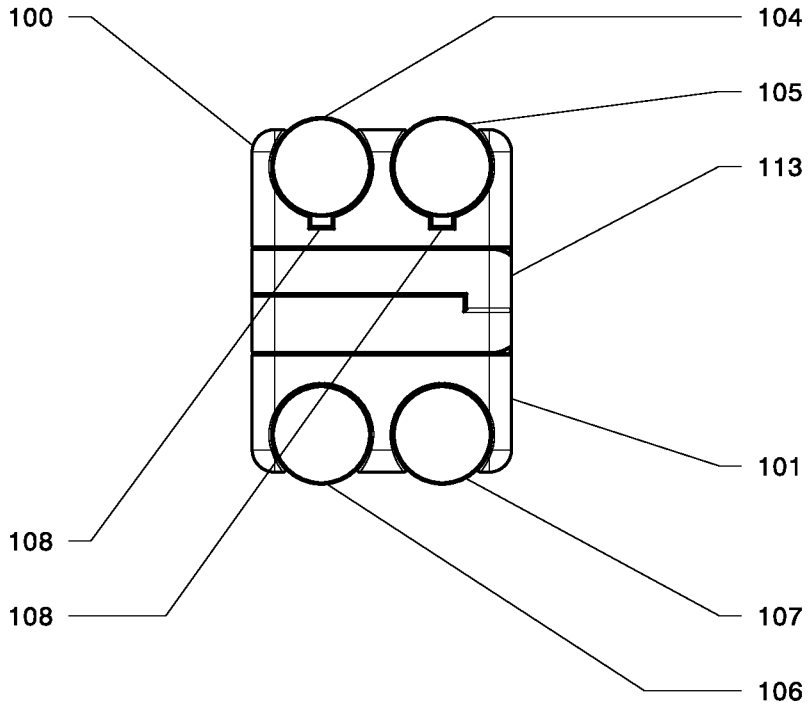
FIG. 4 is a side left view of the base unit as in an embodiment of the portable cosmetic compact.

FIG. 4 is a left view of the compact illustrating the side of base unit 103 and the upper 100 and lower 101 lids which host the tubes 104, 105, 106, and 107. All four tubes 104, 105, 106, and 107 are shown completely inserted in the upper 100 and lower 101 lids, both of which are connected to the base unit 103. As is apparent, the tubes 104, 105, 106, and 107 can be of a cylindrical shape, as in the preferred embodiment, but may be of other shapes as well, such as rectangular, square, rhomboid, or triangular. Moreover, while four tubes 104, 105, 106, and 107 are shown housed in the upper 100 and lower 101 lids, (two tubes within each lid) it is contemplated that one or up to four tubes may be housed within either the upper 100 or lower 101 lids. Also shown is the track system 108 in the upper lid 100 for the upper tubes 104 and 105. The track system for the lower tubes 106 and 107 is on the reverse side. The track system 108 allows the tubes 104, 105, 106, and 107 to be held in various positions within the lid 100 and 101, as well as allowing the tube to be ejected from the lid.

Figure 5:
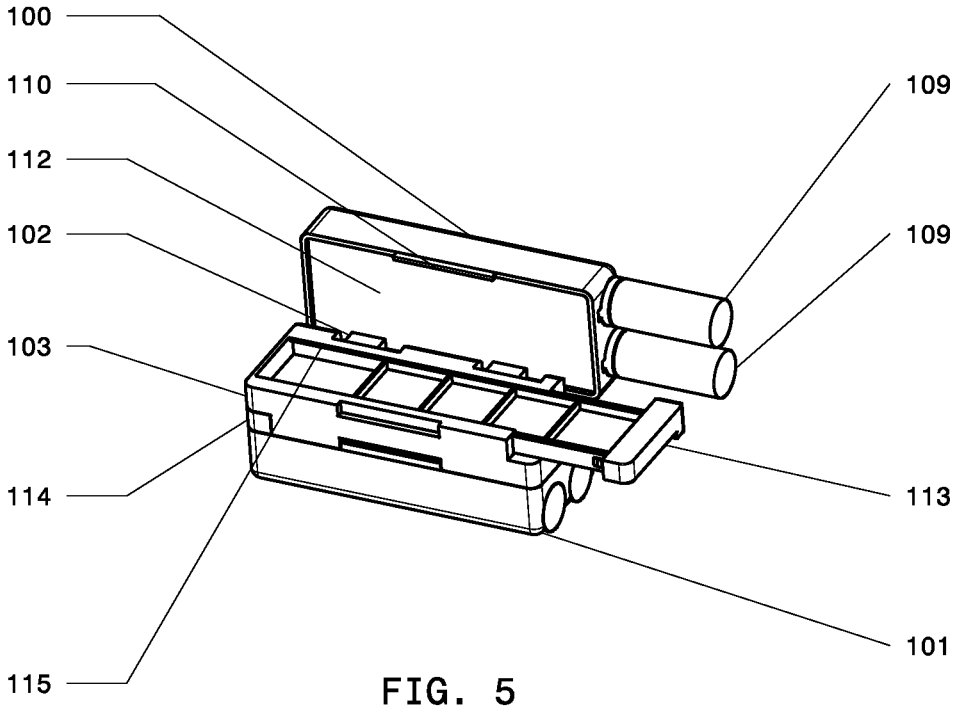
FIG. 5 is a isometric view of the portable interchangeable cosmetic compact, as in one embodiment.

FIG. 5 is an isometric view of the compact. The figure shows the upper 100 lid in the open position and mirror 112 inlayed within the upper 100 lid is exposed to user. A mirror 112 may be provided in the inlayed position within the lower 101 lid as well. The mirror 112 may be lighted or may include illumination. The upper 100 lid is opened via the clasp 110 on the base unit and secured by the hinge 102 on the rear side of the unit. The upper tray 113 is shown protruded from the base unit 103 and said upper tray 113 can host interchangeable pieces that fit within the base unit 103 when the upper tray 113 is closed. The tray 113 can host and store loose products or other desired items. Additionally, two upper tubes 104 and 105 are shown coming out from the upper 100 lid. In this embodiment, the track system 108 is partially invoked, and the caps 109 of the upper tubes 104 and 105 are accessible by the user. Also, the base unit track system 115 is used on both sides.

Figure 6:
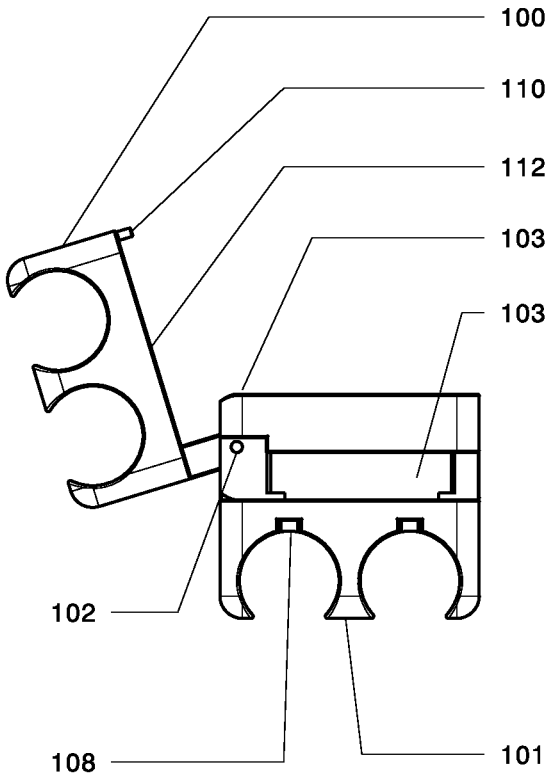
FIG. 6 is a left side view of the portable interchangeable cosmetic compact, illustrating the upper lid in an open position, as in one embodiment

FIG. 6 is a right side view of the portable interchangeable cosmetic compact. This illustration shows the upper lid 100 in the open position. In this position the mirror 112, which may be lighted or include illumination, is exposed for the benefit of the user. The upper lid 100 remains secured to the base unit 103 by the hinges 102. FIG. 6 also illustrates the open recesses for the upper 104 and 105 and lower 106 and 107 tubes. Each tube 104, 105, 106, and 107, as described above, may house a different product or tool selected by the user. Those products include, but are not limited to, blushes, nail varnishes or polishes, sponges, pencil sharpeners, glosses, stains, lipsticks, foundations, concealers, liquid eyeshadows, liquid blushes, eyeliners, mascaras, primers, tinted moisturizers, moisturizers, fragrances, skincare, perfume, and the like. The track system 108 of the lower lid 101 is also shown.

Figure 7:
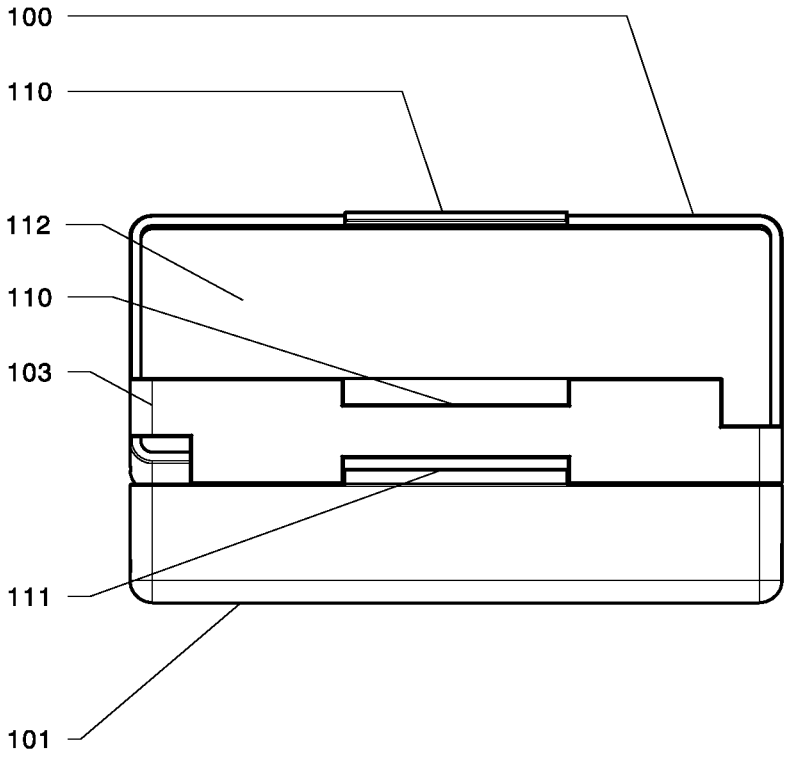
FIG. 7 is a front view of the portable interchangeable cosmetic compact with the upper lid in the open position.

FIG. 7 is a front view of the portable interchangeable cosmetic compact with the upper lid 100 in the open position. The clasp 110 is at the top of the illustration, and the mirror 112 is visible. The base unit 103 houses an upper 113 and lower 114 tray that are further described below. The lower lid 101 is in the closed position, with the lower clasp 111 engaged.

Figure 8:
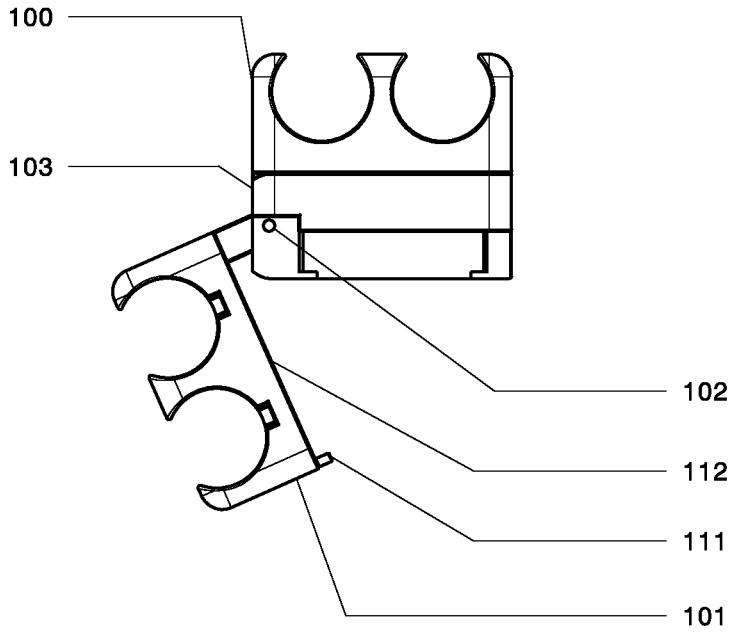
FIG. 8 is a left side view of the portable interchangeable cosmetic compact, illustrating the lower lid in an open position as in one embodiment.

FIG. 8 is a left side view of the portable interchangeable cosmetic compact. This illustration shows the lower lid 101 in the open position. In this position the mirror 112 is exposed for the benefit of the user. The lower lid 101 remains secured to the base unit 103 by the hinges 102. FIG. 8 also illustrates the open recesses for the upper 104 and 105 and lower 106 and 107 tubes. Each tube 104, 105, 106, and 107, as described above, may house a different product or tool selected by the user. Those products include, but are not limited to brushes, nail varnishes and polishes, sponges, pencil sharpeners, glosses, stains, lipsticks, foundations, concealers, liquid eyeshadows, liquid blushes, eyeliners, mascaras, primers, tinted moisturizers, moisturizers, skincare, fragrances, perfume and the like. The track system 108 of the lower lid 101 is also shown.

Figure 9:
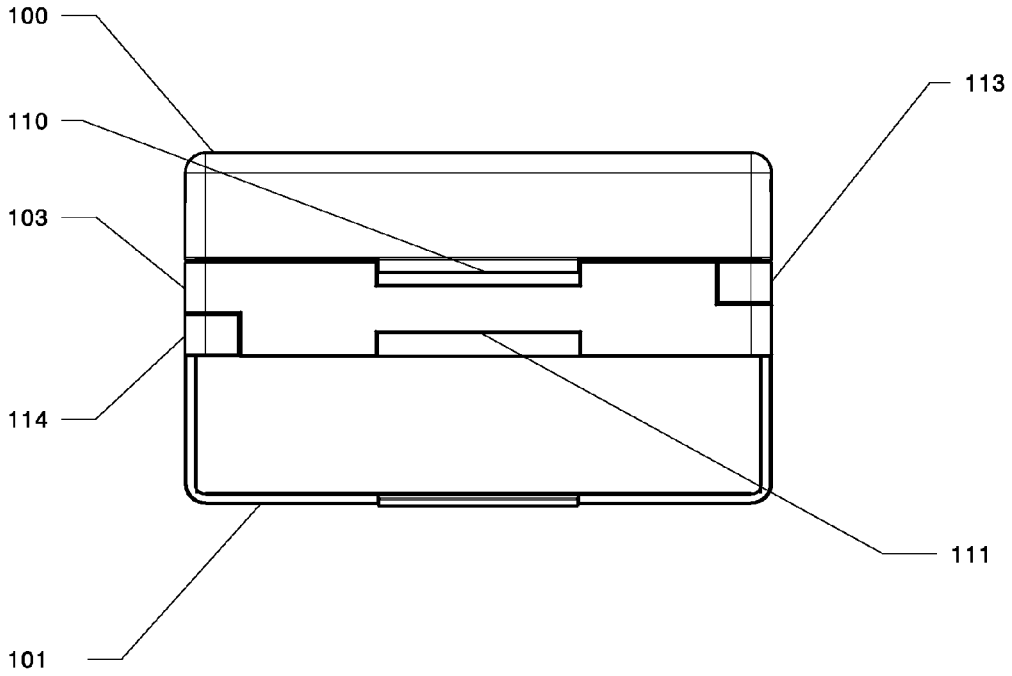
FIG. 9 is a front view of the portable cosmetic interchangeable cosmetic compact with the lower lid in the open position, as in one embodiment.

FIG. 9 is a front view of the portable interchangeable cosmetic compact with the lower lid 101 in the open position. The clasp 111 is at the bottom of the illustration, and the mirror 112 is visible. The base unit 103 houses an upper 113 and lower 114 tray that are further described below. The upper lid 100 is in the closed position, with the upper clasp 110 engaged.

Figure 10:
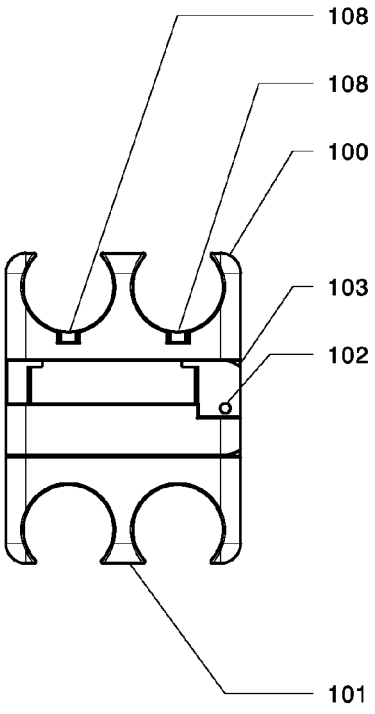
FIG. 10 is a right side view of the portable interchangeable cosmetic compact with trays removed as in one embodiment.

FIG. 10 is a right side view of the portable interchangeable cosmetic compact showing the hinge 102 in detail as well as the base unit 103, the upper lid 100 with the track system 108 and the lower lid 101.

Figure 11:
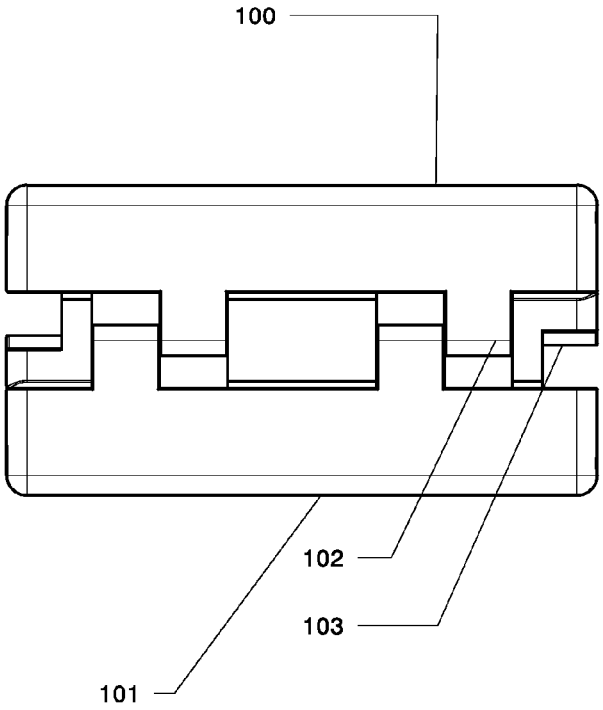
FIG. 11 is a rear view of the portable interchangeable cosmetic compact without the trays.

FIG. 11 is a back view of the portable interchangeable cosmetic compact without the trays illustrated in the other drawings. The upper lid 100 is connected to the base unit 103 via the hinge 102, which connects the base unit 103 to the lower lid 101 as well.

Figure 12:
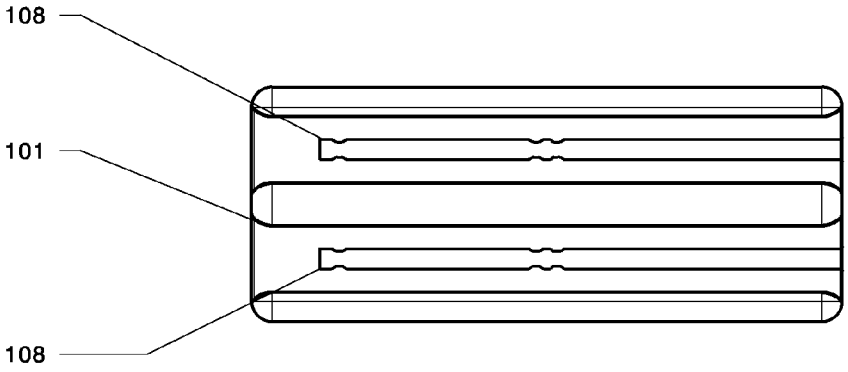
FIG. 12 is a top view of the track system in the lower lid of the portable interchangeable cosmetic compact.

The track system 108 located within both the upper 100 and lower 101 lid, allows a tube 104, 105, 106, and 107 to be secured within the upper 100 or lower 101 lid as shown in FIG. 12 (i.e., tube 104 and 105 are stored within the upper lid 100, the upper lid 100 having a track system 108 for each tube 104 and 105). The track system 108, as shown in FIGS. 2 and 12, allows the user to partially eject a selected tube (any of 104, 105, 106, and 107) and lock the tube in place such that the cap of the tube 109 may be accessed by the user without fully ejecting the selected tube. Partial ejection is achieved through the narrowing of the track near the midline of the unit. Moreover, the track system 108 allows the user to remove any selected tool entirely at the user's discretion. The width of the top portion of the portable compact may be of variable dimensions to accommodate the tools and products housed therein. In one preferred embodiment the width of the compact is approximately 1.36 inches.

Figure 13:
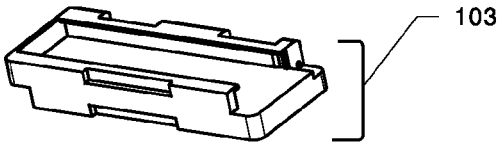
FIG. 13 is an isometric view of the base unit of the portable interchangeable cosmetic compact, in one embodiment.
Figure 14:
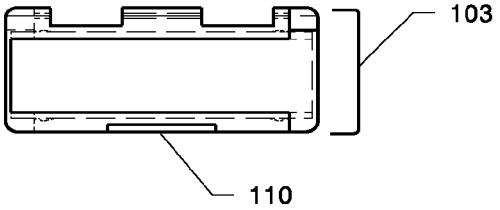
FIG. 14 is a top view of the base unit of the portable interchangeable cosmetic compact, in one embodiment.
Figure 15:
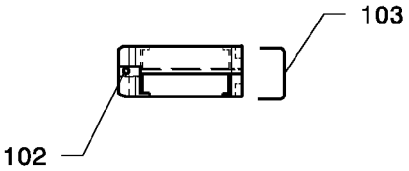
FIG. 15 is a side view of the base unit of the portable interchangeable cosmetic compact, in one embodiment.
Figure 16:
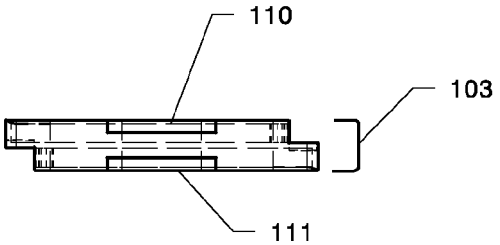
FIG. 16 is a front view of the base unit of the portable interchangeable cosmetic compact, in one embodiment.
Figure 17:
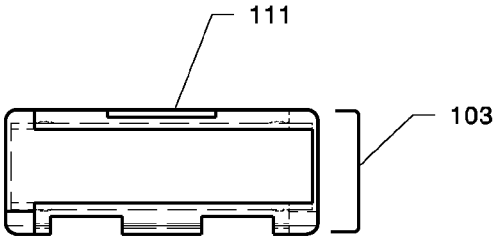
FIG. 17 is a bottom view of the base unit of the portable interchangeable cosmetic compact, in one embodiment.

FIGS. 13-17 illustrate the base unit of the portable interchangeable cosmetic compact. FIG. 13 is an isometric view of the base unit, illustrating the recesses for the upper 110 and lower 111 clasp, cut-outs for the upper 113 and lower 114 trays, as well as placement for the hinges 102. FIG. 14 is a top view of the base unit, the large space may be occupied by a mirror, FIG. 15 is a side view of the base unit 103 and hinge 102 at the side. FIG. 16 shows a front view of the compact, with the dashed lines representing an embodiment for placement of the hinges 102. The upper 110 and lower 111 clasp recesses are visible in FIG. 16. FIG. 17 is a bottom view of the base unit, the large space may be occupied by a mirror, and the lower clasp 111 visible.

Figure 18:
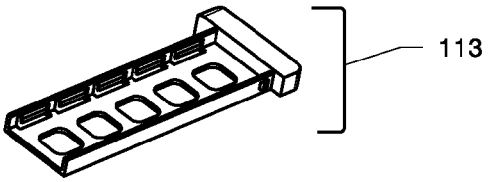
FIG. 18 is an isometric view of the tray of the portable interchangeable cosmetic compact, in one embodiment.
Figure 19:
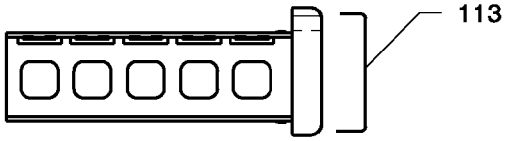
FIG. 19 is a top view of the tray of the portable interchangeable cosmetic compact, in one embodiment.
Figure 20:
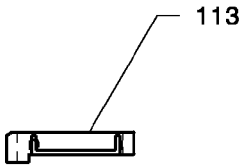
FIG. 20 is a side end view of the tray of the portable interchangeable cosmetic compact, in one embodiment.
Figure 21:
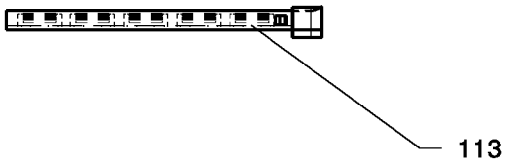
FIG. 21 is a front view of the tray of the portable interchangeable cosmetic compact, in one embodiment.
Figure 22:
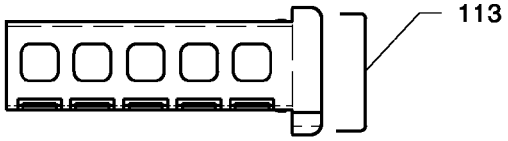
FIG. 22 is a bottom view of the tray of the portable interchangeable cosmetic compact, in one embodiment.

FIGS. 18-22 show the upper tray 113 of the portable interchangeable cosmetic compact. The same illustrations can be used for the lower tray 114. Note, as stated above, the upper tray 113 may be fitted with a variety of cosmetics of the dry, powder, solid, paste or gel nature, including but not limited to, shimmers, bronzers, foundations, eyeshadows, powders, concealers, brow liners, eyeliners, lipsticks, lip glosses, blushes, primers, eyeliner pencils and the like. Moreover, at the users discretion, the upper tray 113 may not house any cosmetic products creating a depression capable of being used as storage for other products or items the user may deem appropriate such as applicator tools, makeup brushes, puffs, sponges, personal grooming tools, tweezers, combs, manicure sets, jewelry, pencil sharpeners, perfumes, skincare items, personal items, hair ties, bobby pins, safety pins, tweezers, q-tips, and the like. FIG. 18 is an isometric view of an upper tray 113 in one configuration contemplated by the portable cosmetic compact. As stated, many configurations can be had with either the upper 113 or lower 114 tray. The number of spaces shown in FIGS. 18-22 are illustrative in nature and not limiting. FIG. 19 is a top view of the upper tray 113, FIG. 20 is a side view, FIG. 21 is a front view, and FIG. 22 is a bottom view.

As is shown in FIG. 5, a second, lower tray 114 is provided that is accessible when the lower lid 101 is accessed. The lower tray 114 is identical to the upper tray 113, in that is may be fitted with a variety of cosmetics of the dry, powder, solid, paste or gel nature, including but not limited to, shimmers, bronzers, foundations, eyeshadows, powders, brow liners, eyeliners, lipsticks, lip glosses, blushes, primers, eyeliner pencils and the like. Moreover, at the users discretion, the lower tray 113 may not house any cosmetics creating a depression capable of being used as storage for other products or items the user may deem appropriate such as applicator tools, makeup brushes, puffs, sponges, personal grooming tools, tweezers, combs, manicure sets, jewelry, pencil sharpener, perfume, skincare, personal items, hair ties, bobby pins, safety pins, tweezers, q-tips, and the like.

Figure 23:
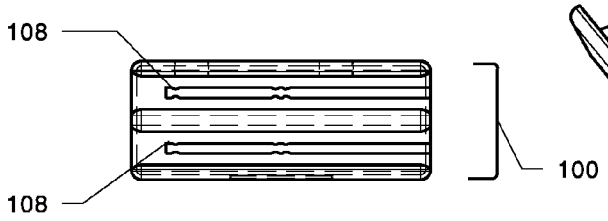
FIG. 23 is a top view of the upper lid of the portable interchangeable cosmetic compact in one embodiment.
Figure 24:
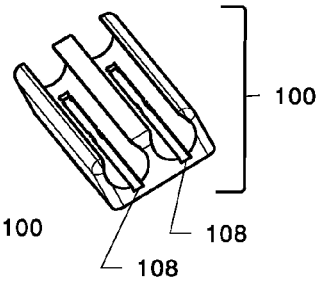
FIG. 24 is an isometric top view of the upper lid of the portable interchangeable cosmetic compact in one embodiment.
Figure 25:
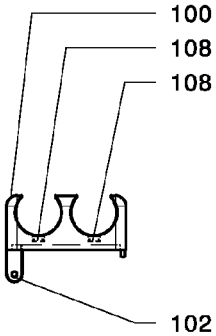
FIG. 25 is a side view of the upper lid of the portable interchangeable cosmetic compact in one embodiment.
Figure 26:
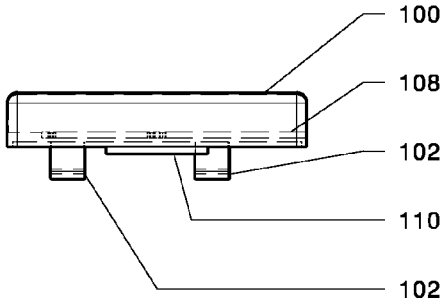
FIG. 26 is a front view of the upper lid of the portable interchangeable cosmetic compact in one embodiment
Figure 27:
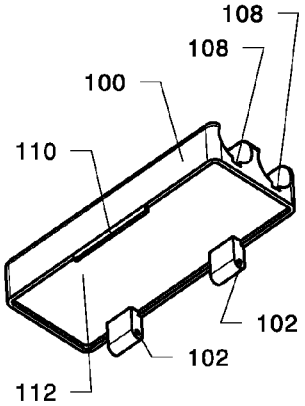
FIG. 27 is an isometric bottom front view of the upper lid of the portable interchangeable cosmetic compact in one embodiment.
Figure 28:
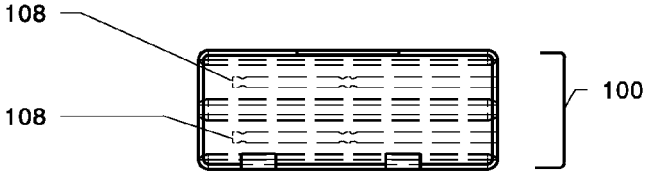
FIG. 28 is a bottom view of the upper lid of the portable interchangeable cosmetic compact in one embodiment.

FIGS. 23-28 show further detail of the upper lid 100 of the portable interchangeable cosmetic compact. It should be noted, that the same elements are present in the lower lid 101. FIG. 23 is a top view of the upper lid 100 illustrating the open recesses for the upper tubes and the track system 108 in which the tubes reside. FIG. 24 is an isometric view of the upper lid 100 illustrating the track system 108 thereon. FIG. 25 is a side view of the upper lid 100. FIG. 26 is a front view of the upper lid 100. FIG. 27 is an isometric bottom view of the upper lid 100, depicting the mirror 112, the hinges 102 that connect the upper lid 100 to the base unit, the clasp 110 that secures the upper lid 100 to the base unit, as well as the recesses for the upper tubes. FIG. 28 is a bottom view of the upper lid 100.

Figure 29:
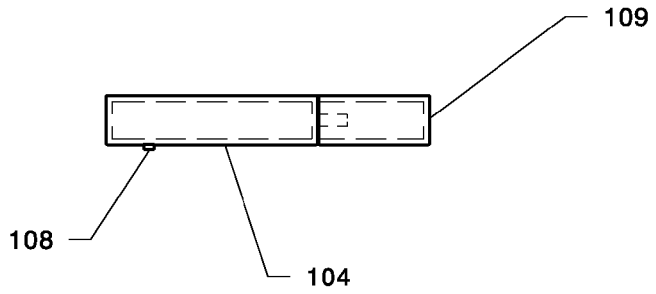
FIG. 29 is a front view of a tube that fits into the upper or lower lid of the portable interchangeable cosmetic compact in one embodiment.
Figure 30:
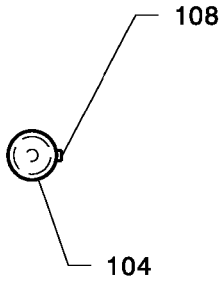
FIG. 30 is a top view of a tube that fits into the upper or lower lid of the portable interchangeable cosmetic compact in one embodiment.
Figure 31:
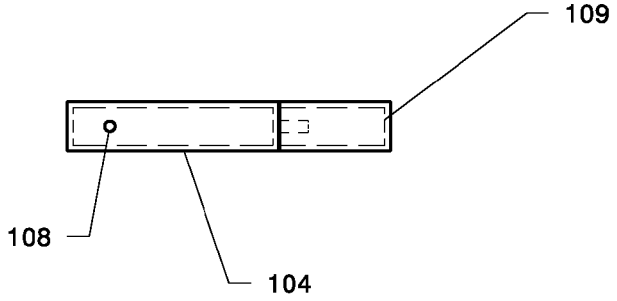
FIG. 31 is a side view, turned ninety degrees from the top view, of a tube that fits into the upper or lower lid of the portable interchangeable cosmetic compact in one embodiment.

FIGS. 29-31 are illustrations of an upper tube 104 of the portable interchangeable cosmetic. Notably, these illustrations are equally applicable to any of the other tubes 105, 106, and 107. Also note, the interior of the tube will vary depending on the type of product contained within. As shown in FIG. 29, a front view of the tube shows the protrusion 108 that engages with, and is part of the track system 108. The cap 109 of the tube is shown. As has been disclosed, the track system 108 has two stops, the first being when the tube is fully encased within the upper or lower lid, and the second where the cap 109 is exposed and accessible to the user. The cap 109 may contain a wand or applicator, as would be well known, when appropriate (i.e., where the tube contains mascara, the cap will have a mascara wand, where the tube contains lip gloss, a lip gloss applicator). The tube may not have a cap. The tube may also be fully removed from the unit. FIG. 30 is a top view of the tube, further detailing the track system 108, and FIG. 31 is a front view rotated ninety degrees to further detail the track mechanism 108 of the portable interchangeable cosmetic.

Each tube 104, 105, 106, and 107 is a separate product, capable of being removed entirely from either the upper 100 or lower 101 lid as desired by the user. Thus, the length of the tube 104, 105, 106, and 107 approximates the length of the unit (as in the preferred embodiment that length is approximately 3.43 inches). Each tube 104, 105, 106, and 107 is secured within the upper 100 or lower 101 lid with a track system 108 within the upper 100 and lower 101 lid.

It will be apparent to those skilled in the art that various modifications and variations can be made in the makeup compact of the present invention without departing from the scope or spirit of the invention and that certain features of one embodiment may be used or interchangeably in other embodiments. Thus, it is intended that the present invention cover all possible combinations of the features shown in the different embodiments, as well as modifications and variations of this invention, provided they come within the scope of the claims and their equivalents. All measurements are approximate and the size of the insert will vary with the scale remaining close to the preferred embodiment described.

What is claimed is:

1. A portable interchangeable cosmetic compact comprising:

a base unit comprising a one end with at least one joint, an opposite end with at least one base unit clasp, a left end between the one end and the opposite end, with an opening which receives an upper tray, and a right end between the one end and the opposite end, with an opening which receives a lower tray, wherein said upper and lower trays engage within the base unit, and the upper and lower trays capable of sliding outward from the base unit until a stopping point, the upper and lower trays capable of holding a multitude of replaceable and/or reusable cosmetics, products, or tools, said upper and lower trays capable of being completely removed from the base unit and replaced; and at least one lid connected by the at least one joint to the base unit at one end and a lid clasp on an opposite end, said lid clasp capable of joining with the base unit clasp of the base unit, and said at least one lid having at least one opening on the upper side that is opposite the side in contact with the base unit, said opening housing a removable tube, and said opening having a track system comprising a linear aperture with variable width, and said removable tube having a protrusion that of an appropriate size to fit within the linear aperture of the track system of the opening wherein the track system secures the removable tube within the at least one lid, and allows the removable tube to slide along the linear aperture and the removable tube protrude from the lid without full ejection, and wherein when the lid is in an open position from the base unit and the clasp is disengaged, the upper and/or lower tray is accessible, wherein the removable tube contains replaceable and/or reusable cosmetics, or reusable and/or replaceable products, or reusable and/or replaceable tools, said removable tube capable of ejecting completely from the at least one lid and being replaced by a second tube.

2. The portable interchangeable cosmetic compact of claim 1, said at least one lid further comprising:

an upper lid, comprising a back end with a joint coupling to the base unit, an upper magnetic clasp on a front end, said upper magnetic clasp capable of being received by an upper magnetic clasp of the base unit, at least one opening on the upper end of the upper lid that is opposite the end in contact with the base unit, said opening housing at least one upper removable tube, said upper removable tube having a cap, and capable of being separated from the upper lid, said upper removable tube being a cosmetic tool, or capable of receiving a product, cosmetic, perfume, or lotion, and said at least one upper removable tube having a protrusion of an appropriate size to fit within the linear aperture of an upper a track system, said upper track system comprising a linear aperture with variable width located within the opening, wherein the linear aperture of the upper track system secures the upper removable tube within the opening, and allows the removable tube to slide along the aperture and to protrude from the lid to expose the cap, and wherein when the lid is in an open position from the base unit and the upper magnetic clasp is disengaged, the upper tray is accessible; and a lower lid, comprising a back end with a joint coupling to the base unit, a lower magnetic clasp on a front end, said lower magnetic clasp capable of being received by a lower magnetic clasp of the base unit, at least one opening on the lower end of the lower lid that is opposite the end in contact with the base unit, said opening housing at least one lower removable tube, said lower removable tube having a cap, and capable of being separated from the lower lid, said lower removable tube being a cosmetic tool, or capable of receiving a product, cosmetic, perfume, or lotion, and said at least one lower removable tube having a protrusion of an appropriate size to fit within the linear aperture of a lower track system, said lower track system comprising a linear aperture with variable width located within the opening, wherein the lower track system secures the lower removable tube within the opening, and allows the lower removable tube to slide along the linear aperture and to protrude from the lid to expose the cap, and wherein when the lid is in an open position from the base unit and the lower magnetic clasp is disengaged, the lower tray is accessible.

3. The portable interchangeable cosmetic compact of claim 1, wherein said upper and lower trays have an outward edge that secures the upper and/or lower tray to the base unit such that the upper tray, when is in a closed position, the outer edge is flush with the upper left or right edge of the base unit, and wherein when the lower tray is in a closed position, the outer edge is flush with lower left or right edge, being opposite the orientation of the upper tray of the base unit, said upper and lower tray further comprising a depression adaptable to receive a plurality of interchangeable cosmetic items, products and/or tools.

4. A portable interchangeable cosmetic compact of claim 1, wherein the upper and/or lower tray contains cosmetics of the dry, powder, liquid, paste or gel nature, comprising shimmers, bronzers, foundations, eyeshadows, concealers, brow liners, eyeliners, lipsticks, lip glosses, lip stains, blushes, concealers, eyeliner pencils, or primers, or tools comprising hair ties, bobby pins, safety pins, tweezers, makeup brushes, puffs, sponges, combs, manicure sets, perfume, skincare, or cotton swabs.

5. A portable interchangeable cosmetic compact of claim 1, wherein the tube contains cosmetic or personal care items of the dry, powder, liquid, paste or gel nature, including gloss, stain, lipstick, foundation, concealer, liquid eyeshadow, liquid blush, eyeliner, mascara, primer, tinted moisturizer, moisturizer, concealer, shimmer, glitter, brushes, nail varnishes or polishes, cuticle oils, sponges, pencil sharpeners, tweezers, skincare, perfume, or fragrance.

6. A portable interchangeable cosmetic compact of claim 1, wherein the at least one lid has a mirror on the under side that is exposed when the clasp is in an open position.

7. A portable interchangeable cosmetic compact of claim 1, wherein the track system is in the midline of the opening and in contact with the at least one lid, the opening being exposed on the upper side of the at least one lid, whereby the opening allows a user to easily access the separate tube.

8. A portable interchangeable cosmetic compact of claim 1, wherein the portable interchangeable cosmetic compact is circular or rectangular in shape.

9. The portable interchangeable cosmetic compact of claim 1, wherein the removable tube is cylindrical or rectangular in shape.

10. The portable interchangeable cosmetic compact of claim 1, wherein the joint means is two hinges on the back end of the base unit.

11. The portable interchangeable cosmetic compact of claim 1, wherein the clasp is magnetic.

12. A portable interchangeable cosmetic compact comprising:

a base unit comprising a back end with at least one hinge, a front end with magnetic clasp, a left end with an opening which receives an upper tray, and a right end with an opening which receives a lower tray, wherein said upper and lower trays engage within the base unit, and capable of sliding outward from the base unit and having an outward edge that secures the upper and/or lower tray to the base unit such that the upper tray, when in a closed position, the outer edge is flush with the upper left or right edge of the base unit, and wherein when the lower tray in a closed position, the outer edge is flush with lower left or right edge, being opposite the orientation of the upper tray of the base unit, said upper and lower tray further comprising a depression adaptable to receive a plurality of interchangeable cosmetic items, products or tools, and said upper and lower tray being replaceable and reusable;

an upper lid, comprising a back end with a joint coupling to the base unit, an upper magnetic clasp on a front end, said upper magnetic clasp capable of being received by an upper magnetic clasp of the base unit, at least one opening on the upper end of the upper lid that is opposite the end in contact with the base unit, said opening housing at least one upper removable tube, said upper removable tube having a cap, and capable of being separated from the upper lid, said upper removable tube being a cosmetic tool, or capable of receiving a cosmetic, product, perfume, or lotion, and said at least one upper removable tube having a protrusion of an appropriate size to fit within a linear aperture of a upper track system, said upper track system located within the opening and comprising the linear aperture with variable width, wherein the upper track system secures the upper removable tube within the opening, allows the upper removable tube slide along the linear aperture to protrude from the lid to expose the cap, and wherein when the lid is in an open position from the base unit and the upper magnetic clasp is disengaged, the upper tray is accessible; and a lower lid, comprising a back end with a joint coupling to the base unit, a lower magnetic clasp on a front end, said lower magnetic clasp capable of being received by a lower magnetic clasp of the base unit, at least one opening on the lower end of the lower lid that is opposite the end in contact with the base unit, said opening housing at least one lower removable tube, said lower removable tube having a cap, and capable of being separated from the upper lid, said lower removable tube being a cosmetic tool, or capable of receiving a cosmetic, product, perfume, or lotion, and said at least one lower removable tube having a protrusion of an appropriate size to fit within the linear aperture of a lower track system, said lower track system comprising the linear aperture with variable width located within the opening, wherein the lower track system secures the lower removable tube within the opening, and allows the lower removable tube to slide along the linear aperture and the lower removable tube protrude from the lid to expose the cap, and wherein when the lid is in an open position from the base unit and the lower magnetic clasp is disengaged, the lower tray is accessible.

13. A portable interchangeable cosmetic compact of claim 12, wherein the upper and/or lower tray contains cosmetics of the dry, powder, liquid, paste or gel nature, comprising shimmers, bronzers, foundations, eyeshadows, concealers, brow liners, eyeliners, lipsticks, lip glosses, lip stains, blushes, concealers, eyeliner pencils, or primers, or tools comprising hair ties, bobby pins, safety pins, tweezers, makeup brushes, puffs, sponges, combs, manicure sets, perfume, skincare, or cotton swabs.

14. A portable interchangeable cosmetic compact of claim 12, wherein the removable tube contains cosmetic or personal care items of the dry, powder, liquid, paste or gel nature, including gloss, stain, lipstick, foundation, concealer, liquid eyeshadow, liquid blush, eyeliner, mascara, primer, tinted moisturizer, moisturizer, concealer, shimmer, glitter, brushes, nail varnishes or polishes, cuticle oils, sponges, pencil sharpeners, tweezers, skincare, perfume, or fragrance.

15. A portable interchangeable cosmetic compact of claim 12, wherein the at least one lid has a mirror on the under side that is exposed when the clasp is in an open position.

16. A portable interchangeable cosmetic compact of claim 12, wherein the track system is in the midline of the opening and in contact with the at least one lid, the opening being exposed on the upper side of the at least one lid, whereby the opening allows a user to easily access the separate tube.

17. A portable interchangeable cosmetic compact comprising:

a base unit comprising a back end having two flanges with an opening that create two hinges with an upper lid, a front end with an upper and a lower clasp, a left end with an opening which receives an upper tray, and a right end with an opening which receives a lower tray, wherein said upper and lower trays engage within the base unit, and capable of sliding outward from the base unit and having an outward edge that secures the upper and/or lower tray to the base unit such that the upper tray, when in a closed position, the outer edge is flush with the upper left or right edge of the base unit, and wherein when the lower tray is in a closed position, the outer edge is flush with lower left or right edge, being opposite the orientation of the upper tray of the base unit, said upper and lower tray further comprising a depression adaptable to receive a plurality of interchangeable cosmetic items, products or tools, and said upper and lower tray being replaceable and reusable;

an upper lid, comprising a back end having two flanges with an opening and connected to the base unit by the hinges made by the flanges of the base unit meeting with the flanges of the upper lid, an upper clasp on a front end, said upper clasp capable of being received by the upper clasp of the base unit, a first and a second opening on the upper end of the upper lid that is opposite the end in contact with the base unit, said first and second opening receiving a first and a second upper removable tube, said first and upper tube being adjacent to one another, said first and second upper tube each having a cap, and said first and second upper removable tube removable from the upper lid, said first and said second upper removable tube containing an interchangeable cosmetic tool, or capable of receiving a cosmetic, product, perfume, or lotion, said first and second upper removable tube being replaceable and reusable, and said first and second upper removable tube having a protrusion of an appropriate size to fit within a linear aperture of an upper a track system, said upper track system comprising the linear aperture with variable width located within both the first and second opening, wherein the linear aperture of the upper track system secures the first and second upper removable tube within the first and second opening, respectively, and, allows the first and/or second upper removable tube slide along the linear aperture to protrude from the lid to expose the cap, and wherein when the lid is in an open position from the base unit and the upper clasping means is disengaged, the upper tray is accessible; and a lower lid, comprising a back end coupled to the base unit by said lower two hinges, a lower clasp on a front end, said lower clasp capable of being received by a lower clasp of the base unit, a first and a second opening on the lower end of the lower lid that is opposite the end in contact with the base unit, said opening receiving a first and a second lower removable tube, said first and second lower tube being adjacent to one another, said first and second lower removable tube having a cap, and said lower removable tubes capable of being separated from the upper lid, said lower removable tube containing an interchangeable cosmetic tool, or capable of receiving a cosmetic, product, perfume, or lotion, said lower tube being replaceable and reusable, and said first and second lower tube having a protrusion of an appropriate size to fit within a linear aperture of an upper a lower track system, said lower track system comprising the linear aperture with variable width located within both the first and second opening, wherein the linear aperture of the lower track system secures the first and second lower tube within the first and second opening, respectively, and allows the first and/or second lower tube to slide along the linear aperture and protrude from the lid to expose the cap, and wherein when the lid is in an open position from the base unit and the lower clasp is disengaged, the lower tray is accessible.

18. A portable interchangeable cosmetic compact of claim 17, wherein the upper and/or lower tray contains cosmetics of the dry, powder, liquid, paste or gel nature, comprising shimmers, bronzers, foundations, eyeshadows, concealers, brow liners, eyeliners, lipsticks, lip glosses, lip stains, blushes, concealers, eyeliner pencils, or primers, or tools comprising hair ties, bobby pins, safety pins, tweezers, makeup brushes, puffs, sponges, combs, manicure sets, perfume, skincare, or cotton swabs.

19. A portable interchangeable cosmetic compact of claim 17, wherein the first and/or second removable tube contains cosmetic or personal care items of the dry, powder, liquid, paste or gel nature, including gloss, stain, lipstick, foundation, concealer, liquid eyeshadow, liquid blush, eyeliner, mascara, primer, tinted moisturizer, moisturizer, concealer, shimmer, glitter, brushes, nail varnishes or polishes, cuticle oils, sponges, pencil sharpeners, tweezers, skincare, perfume, or fragrance.

20. A portable interchangeable cosmetic compact of claim 17, wherein the at least one lid has a mirror on the under side that is exposed when the clasp is in an open position.

21. A portable interchangeable cosmetic compact of claim 17, wherein the track system is in the midline of the opening and in contact with the at least one lid, the opening being exposed on the upper side of the at least one lid, whereby the opening allows a user to easily access the tube.

* * * * *